US007683849B2

(12) United States Patent
Schadler et al.

(10) Patent No.: US 7,683,849 B2
(45) Date of Patent: Mar. 23, 2010

(54) SYSTEM AND METHOD OF PRODUCING A NULL FREE OBLONG AZIMUTH PATTERN WITH A VERTICALLY POLARIZED TRAVELING WAVE ANTENNA

(75) Inventors: John L. Schadler, Raymond, ME (US); Andre Skalina, Portland, ME (US)

(73) Assignee: SPX Corporation, Charlotte, NC (US)

( * ) Notice: Subject to any disclaimer, the term of this patent is extended or adjusted under 35 U.S.C. 154(b) by 333 days.

(21) Appl. No.: 11/826,102

(22) Filed: Jul. 12, 2007

(65) Prior Publication Data

US 2008/0079647 A1 Apr. 3, 2008

Related U.S. Application Data

(63) Continuation-in-part of application No. 11/499,644, filed on Sep. 29, 2006, now Pat. No. 7,327,325.

(51) Int. Cl.
*H01Q 21/12* (2006.01)

(52) U.S. Cl. ..... 343/814; 343/798; 343/810

(58) Field of Classification Search ..... 343/798, 343/800, 810, 814, 816, 890
See application file for complete search history.

(56) References Cited

U.S. PATENT DOCUMENTS 2,338,564 A * 1/1944 Aram ..... 343/798
2,691,102 A * 10/1954 Masters ..... 343/800
2,947,988 A 8/1960 Masters
3,665,479 A * 5/1972 Silliman ..... 343/726
4,518,969 A * 5/1985 Bogner ..... 343/819
5,506,591 A * 4/1996 Dienes ..... 343/792

OTHER PUBLICATIONS

Philip S. Carter, "Antenna Arrays Around Cylinders", Proceedings of the I.R.E., Dec. 1943, pp. 671-693, vol. 31, issue 12.

* cited by examiner

*Primary Examiner*—Tho G Phan
(74) *Attorney, Agent, or Firm*—Baker & Hostetler LLP

(57) ABSTRACT

A vertically polarized traveling wave antenna forms peanut-type directional lobes without significant nulls between the lobes. A self-supporting coaxial line feeds quad-dipole bays coupled around the coaxial line, with opposed dipole pairs spaced along the coaxial line. Matched-layer spacing provides substantial cancellation of the reactive components of the loads. Dipoles are oriented parallel to the coaxial line axis, with opposite "hot" (center coupled) elements oppositely oriented. Radiated signals have rotating phase. Changing the spacing within quads from a quarter wavelength or rotating the second dipole pair of each quad away from a right angle causes the antenna to radiate strongly on one axis and weakly at right angles thereto, without the nulls of back-to-back panel antennas.

10 Claims, 7 Drawing Sheets

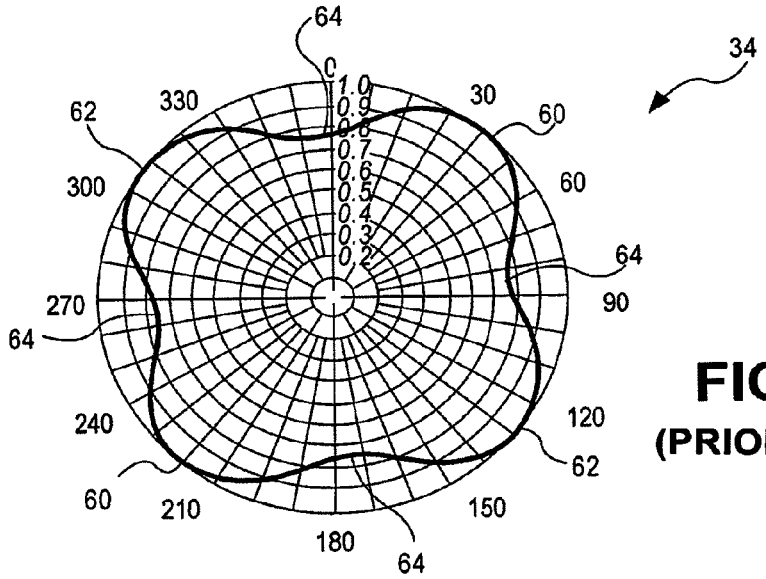
FIG. 2
(PRIOR ART)
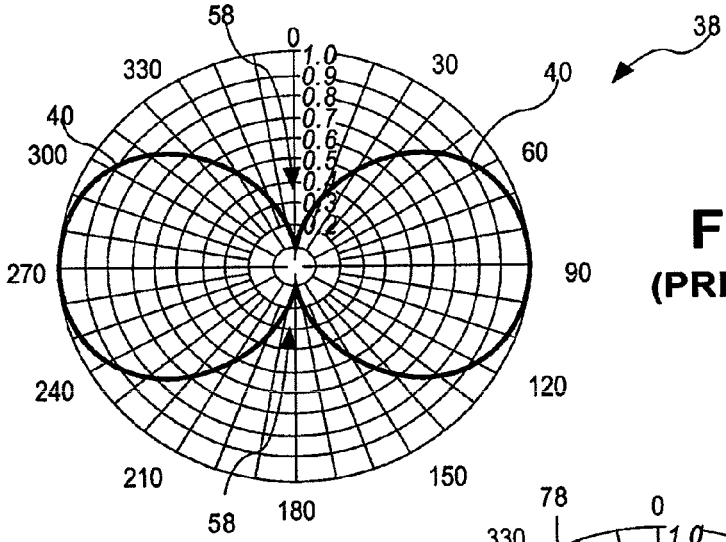
FIG. 4
(PRIOR ART)
FIG. 8
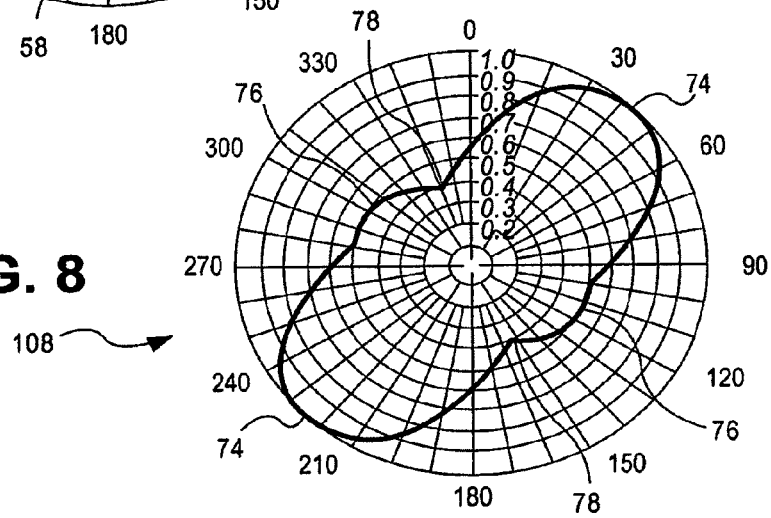

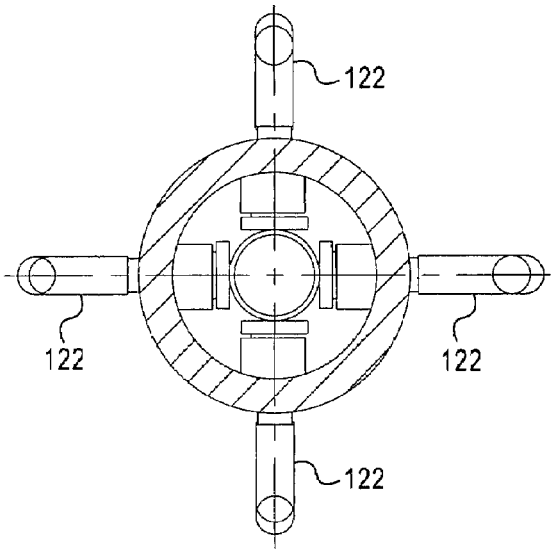
FIG. 10
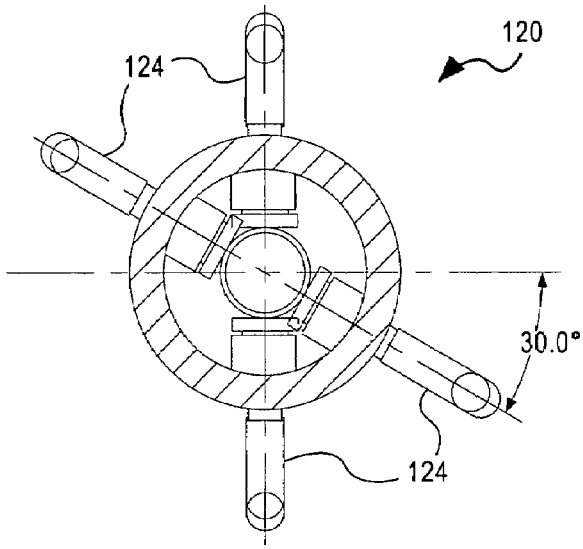
FIG. 11
FIG. 13
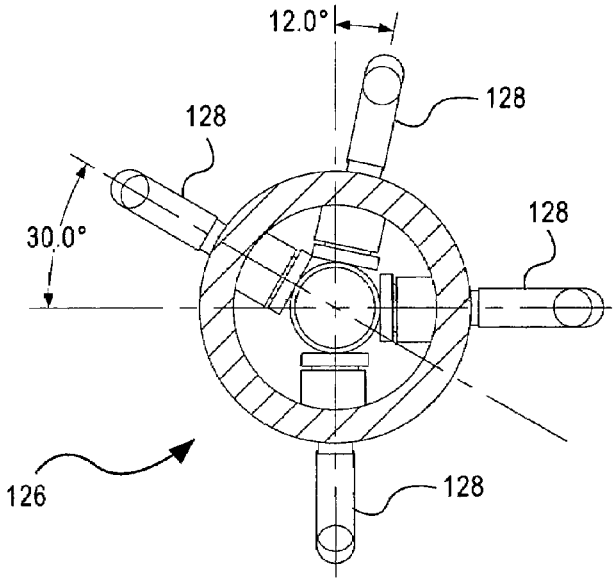

SYSTEM AND METHOD OF PRODUCING A NULL FREE OBLONG AZIMUTH PATTERN WITH A VERTICALLY POLARIZED TRAVELING WAVE ANTENNA

RELATED APPLICATIONS

This application is a continuation-in-part of U.S. nonprovisional patent application Ser. No. 11/499,644 ("the '644 application"), titled, "Vertically Polarized Traveling Wave Antenna System and Method", filed Sep. 29, 2006, now U.S. Pat No. 7,327,325 which is hereby incorporated by reference in its entirety.

FIELD OF THE INVENTION

The present invention relates generally to radio frequency (RF) electromagnetic signal broadcast antennas. More particularly, the present invention relates to traveling-wave linear array transmitting antennas.

BACKGROUND OF THE INVENTION

There has recently been an industry focus on digital streaming of content to mobile, portable, and handheld receivers through terrestrial broadcast systems. This type of broadcasting is being developed for implementation in licensed UHF frequency bands such as 0.7 GHz to 1.0 GHz (upper L-Band: TV channels 52 and above; mobile radio) and 1 GHz to 2 GHz (lower S-band).

At L-Band frequencies, the preferred method of transmission is vertical polarization. There are at present two styles of vertically polarized antennas that are readily available for commercial use in transmission at these microwave frequencies, namely panel and whip antennas. Panel antennas are intrinsically directional in nature and are typically used to cover sectors of space. Whip antennas are nominally omnidirectional and are used preferentially in applications requiring substantially equal radiation in all azimuths.

The shortcomings of a vertically polarized collinear dipole antenna include limited capacity to realize beam tilt. Increased input loading with additional dipoles constrains input transformer performance for both power and bandwidth. Structural support is provided largely by the radome.

The shortcomings of panel antennas include requirements to provide extensive systems of power dividers and feed lines where multiple panels must transmit carefully phased inputs, a panel or an array of panels pointing in each direction (typically four quadrants for omnidirectional capability, with overall antenna gain dependent on array size), use of a tower with multiple discrete units mounted thereon, and accommodation of wind loading from multiple units.

The vertically polarized traveling wave antenna apparatus, means, and design methods disclosed in the '644 application permit production of an omnidirectional antenna that permits simplicity in its mechanical construction, minimal design adaptation to vary beam tilt and null fill, matched input impedance substantially independent of the number of elements, excellent azimuth pattern circularity, and moderate power capability.

Some omnidirectional antennas are useful in many but not all applications. For example, in an open environment in a city, need for mobile broadcast service may surround a transmitter site, so that an omnidirectional antenna is appropriate. However, in other environments, such as along highways, it may be preferable to supply service only or primarily in line with the roadway, which can allow narrower focus of the same energy, permitting fewer or less power-consuming devices to achieve a level of coverage.

The known antennas for providing such patterns are largely limited to the above-referenced panel radiators and arrays thereof. Such panels are effectively unidirectional, with a single beam having breadth that depends on the intrinsic gain of the individual panel, increasingly narrow as the number of cofiring panels in an array increases. If a single site is intended for placement midway along a substantially straight section of road, for example, it is necessary to place two panels (or stacks of panels) back-to-back to provide a so-called "peanut" propagation pattern. This produces deep nulls to the sides, which are potentially unacceptable for mobile coverage, and may necessitate adding one or more auxiliary panels oriented in the short-range directions.

As the desired gain/range/beam narrowness of the transmitter site increases, and thus the number of panels, complexity increases. Each panel must be fed, so the original signal must be split using power dividers and feed lines. Each added connection has the potential to reduce system reliability. Feed for auxiliary panels must be provided at power levels suited to the desired azimuth pattern.

Panel antennas may also be more configurationally complex than traveling wave dipoles in some embodiments. Thus, there are significant limitations in some antenna types when considered for the power, economy, and coverage of broadcasting applications to which the invention is directed.

SUMMARY OF THE INVENTION

The foregoing disadvantages are overcome, to a great extent, by the invention, wherein in one aspect a vertically polarized traveling wave antenna is provided that in some embodiments of the invention affords simplicity in mechanical construction, reduced need for design modification to vary beam tilt and null fill, matched input impedance substantially independent of the number of elements, and moderate power capability, while providing a desirable azimuth pattern for selected non-omnidirectional applications.

In accordance with one embodiment of the invention, an antenna system for radio frequency (RF) electromagnetic signals over a frequency range is presented. The antenna includes a substantially vertical and linear coaxial transmission line having an outer conductor and an inner conductor with a common longitudinal axis. The transmission line originates at an origination node and ends at a terminal node. A plurality of vertically polarized dipoles that form a first bay occupy a first longitudinal position, proximal to the origination node. The first bay dipoles include elements coupled to the inner conductor at a plurality of azimuthal and longitudinal positions, jointly providing impedance cancellation at least in part. A combination of azimuthal position and relative longitudinal position of the first bay dipoles realizes substantially a non-omnidirectional pattern of RF signal strength and gain.

In accordance with another embodiment of the invention, a vertically polarized traveling wave antenna system for radio frequency (RF) electromagnetic signals over a frequency range is presented. The antenna includes a rotating-phase RF signal emitter that exhibits an azimuthal propagation pattern having two substantially equal principal lobes on opposite sides of a longitudinal axis of the emitter and two smaller intermediate lobes therebetween.

The antenna further includes a coaxial transmission line from an origination node to a terminal node. The coaxial transmission line has a substantially vertically-oriented longitudinal axis, and further has a first RF signal coupler that couples an applied signal in part radially away from the coaxial transmission line. The first RF signal coupler is located at a prescribed distance from the origination node. The coaxial transmission line further has a second RF signal coupler that couples the applied signal in part radially away from the coaxial transmission line. The second RF signal coupler is located at substantially the same prescribed distance from the origination node as the first RF signal coupler. The first RF signal coupler lies in a first half-plane bounded by the longitudinal axis of the coaxial transmission line. The second RF signal coupler lies in a second half-plane bounded by the longitudinal axis of the coaxial transmission line. The first and second half-planes are substantially coplanar and noncoincident.

The antenna further includes a first dipole for radiating RF signal energy coupled from the coaxial transmission line with a first axis of vertical polarization, and a second dipole for radiating the RF signal energy coupled from the coaxial transmission line with a second axis of vertical polarization parallel to and inverted with respect to the first polarization axis. The first and second dipoles lie in the half-planes of the respective first and second RF signal couplers.

The antenna further includes a third RF signal coupler for coupling the RF signal in part radially away from the coaxial transmission line. The third RF signal coupler is located at a distance from the origination node equal to the distance of the first RF signal coupler, plus an additional increment sufficient to provide impedance cancellation at least in part, plus yet another increment sufficient to provide added phase shift to a prescribed extent. The third RF signal coupler lies in a third half-plane bounded by the longitudinal axis of the coaxial transmission line and perpendicular to the half-planes of the first and second RF signal couplers. The antenna further includes a fourth RF signal coupler for coupling the RF signal in part radially away from the coaxial transmission line. The fourth RF signal coupler is located at substantially the same distance from the origination node as the third RF signal coupler. The fourth RF signal coupler lies in a fourth half-plane bounded by the longitudinal axis of the coaxial transmission line. The third and fourth half-planes are substantially coplanar and noncoincident.

The antenna further includes a third dipole for radiating RF signal energy coupled from the coaxial transmission line with a third axis of vertical polarization, wherein the third axis is parallel to one of the first axis and the second axis, and fourth dipole for radiating RF signal energy coupled from the coaxial transmission line with a fourth axis of vertical polarization, parallel to and inverted with respect to the third polarization axis, wherein the prescribed extent of RF signal phase shift is sufficient to attenuate the RF signal from the third and fourth dipoles to a prescribed extent relative to the RF signal from the first and second dipoles, and wherein the third and fourth dipoles lie in the half-planes of the respective third and fourth RF signal couplers.

In accordance with still another embodiment of the invention, a method for coupling electromagnetic energy with vertical polarization from a transmitting apparatus to a region of space above generalized terrain is presented. The method includes propagating an RF signal from an origination node to a terminal node, with reference to a longitudinal axis of propagation, and capacitively coupling portions of the RF signal radially away from the longitudinal axis in substantially equal parts at a first point, a second point, a third point, and a fourth point within a first bay. The respective capacitive couplings are substantially radially distributed and are located at a plurality of prescribed distances from the origination node. The respective radial capacitive couplings occur within a first, a second, a third, and a fourth half-plane bounded by the longitudinal axis of propagation.

The method further includes positioning paired first and second coupling points and paired third and fourth coupling points with near-quarter-wave spacing between the pairs, wherein the spacing provides impedance canceling at least in part, radiating RF signal energy as coupled from the longitudinal axis at the first, second, third, and fourth coupling points using respective first, second, third, and fourth dipoles. The respective dipoles are individually oriented to emit at near-90-degree phase intervals, and provide phase rotation with respect to the longitudinal axis. The respective dipole orientations establish, by an extent of deviation of dipole spacing from paired quarter-wave longitudinal spacing and 90 degree azimuthal spacing, an azimuth lobe pattern including a first primary lobe and a second primary lobe, opposite one another in both azimuth and phase. The first and second primary lobe signals propagate away from the longitudinal axis with roughly equal magnitude. The respective dipole orientation deviations further establish first and second secondary lobes having intermediate phase and having respective peak magnitudes lower than the primary lobes. The respective dipole orientation deviations further establish a first null and a second null having respective minima that provide a prescribed degree of interlobe fill at all azimuths with reference to the primary lobe maxima.

There have thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments, and of being practiced and carried out in various ways. It is also to be understood that the phraseology and terminology employed herein, as well as the abstract, are for the purpose of description, and should not be regarded as limiting.

As such, those skilled in the art will appreciate that the conception upon which this disclosure is based may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIG. 2 is a calculated chart plotting signal strength versus azimuth for a prior art antenna.

FIG. 4 is a calculated chart plotting signal strength versus azimuth for the panel antenna shown in FIG. 3.

FIG. 8 is a calculated chart plotting signal strength versus azimuth according to one embodiment of the invention.

FIG. 10 is a section view of an antenna according to one embodiment of the invention.

FIG. 11 is a section view of an antenna according to one embodiment of the invention.

FIG. 13 is a section view of an antenna according to one embodiment of the invention.

DETAILED DESCRIPTION OF THE INVENTION

Figure 1:
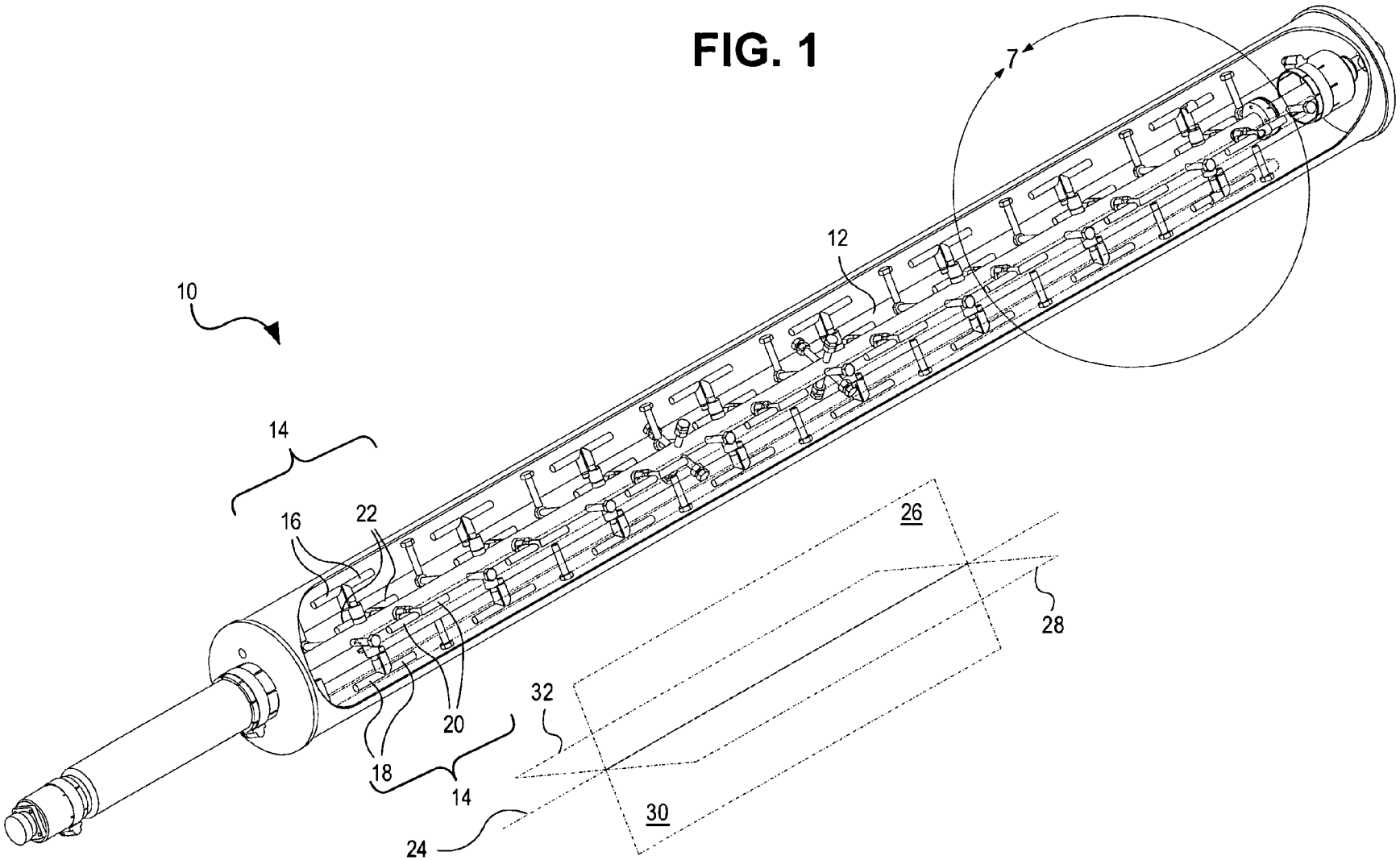
FIG. 1 is a perspective view of a multiple-bay antenna according to one embodiment of the invention.

The invention will now be described with reference to the drawing figures, in which like reference numerals refer to like parts throughout. The invention provides an apparatus and method that in some embodiments provides an antenna that supports a substantially single-axis, null-free, vertically-polarized propagation pattern with high gain and moderate power handling capability.

FIG. 1 shows a multiple-bay antenna 10 according to one embodiment of the invention. The antenna 10 uses a self-supporting, vertical, straight coaxial line (coax) 12 to couple a signal between a feed line and multiple radiating elements in the form of a traveling wave. At each bay 14, a first dipole 16 and a second dipole 18 are positioned on opposite sides of the coax 12, with the second dipole 18 inverted with respect to the first dipole 16, so that the polarities of the radiated signals are opposite. It is noted that the cylindrical and effectively grounded outer conductor of the coax 12 is interposed between the dipoles 16, 18, and substantially blocks direct propagation from each toward the other. Similarly, also at each bay 14, a third dipole 20 and a fourth dipole 22 are positioned on opposite sides of the coax 12, and are oppositely oriented to each other, thus likewise radiating signals of opposite polarity. The signals from the second dipole pair 20, 22 are delayed with respect to signals from the first dipole pair 16, 18 by a prescribed portion of a wavelength proportional to the displacement of the tap locations of the second dipole pair 20, 22 with respect to the first dipole pair 16, 18 along the coax 12, discussed in greater detail below. The longitudinal axes of the dipoles 16, 18, 20, and 22 in all bays 14 lie in the half-planes 26, 28, 30, and 32 in at least some embodiments of the invention.

Vertical spacing of bays 14 as shown in FIG. 1 (i.e., distance along the longitudinal axis of the antenna 10 from a prescribe point on a first bay 14 to the corresponding point on a second bay 14) is approximately one wavelength per bay 14. This dimension can be adjusted over a comparatively broad range to achieve both beam tilt (by shortening the distance slightly from one wavelength) and null fill (by adjusting spacing to be slightly nonuniform, which broadens primary and secondary beams).

For convenience, the orientation axis 24 next to the antenna 10 in FIG. 1 shows four half-planes 26, 28, 30, and 32, each bounded by the orientation axis 24. The axis 24 represents the longitudinal axis of the coax 12, which is the vertical axis of the antenna 10. The longitudinal axes of the radial and vertical components of the conductors making up the respective dipoles 16, 18, 20, and 22 in all bays 14 lie in the half-planes 26, 28, 30, and 32, respectively.

Far-field signals from phase rotation-type antennas such as those of the '644 application are represented in the signal strength chart 34 of FIG. 2. FIG. 2 depicts the radiation pattern 34 with respect to azimuth of an antenna according to the '644 application, showing substantially omnidirectional emission. As noted, this is undesirable for some applications, if a substantial portion of the emitted energy propagates in unwanted directions. It may be observed that the approximate fourfold radial symmetry of this pattern 34 produces two pairs of principal lobes 60 and 62, respectively, one pair at roughly 40 degrees and 210 degrees, the other pair at roughly 130 degrees and 310 degrees. The nulls 64 have signal strength reduced by about 2.4 dB (20 log (0.76)) compared to the lobes 60, 62.

Signals from phase rotation-type antennas are substantially indistinguishable those emitted from antennas that emit signals simultaneously from a plurality of elements in each bay. An example of the latter antenna is a panel antenna 36, as represented in FIG. 3.

Figure 3:
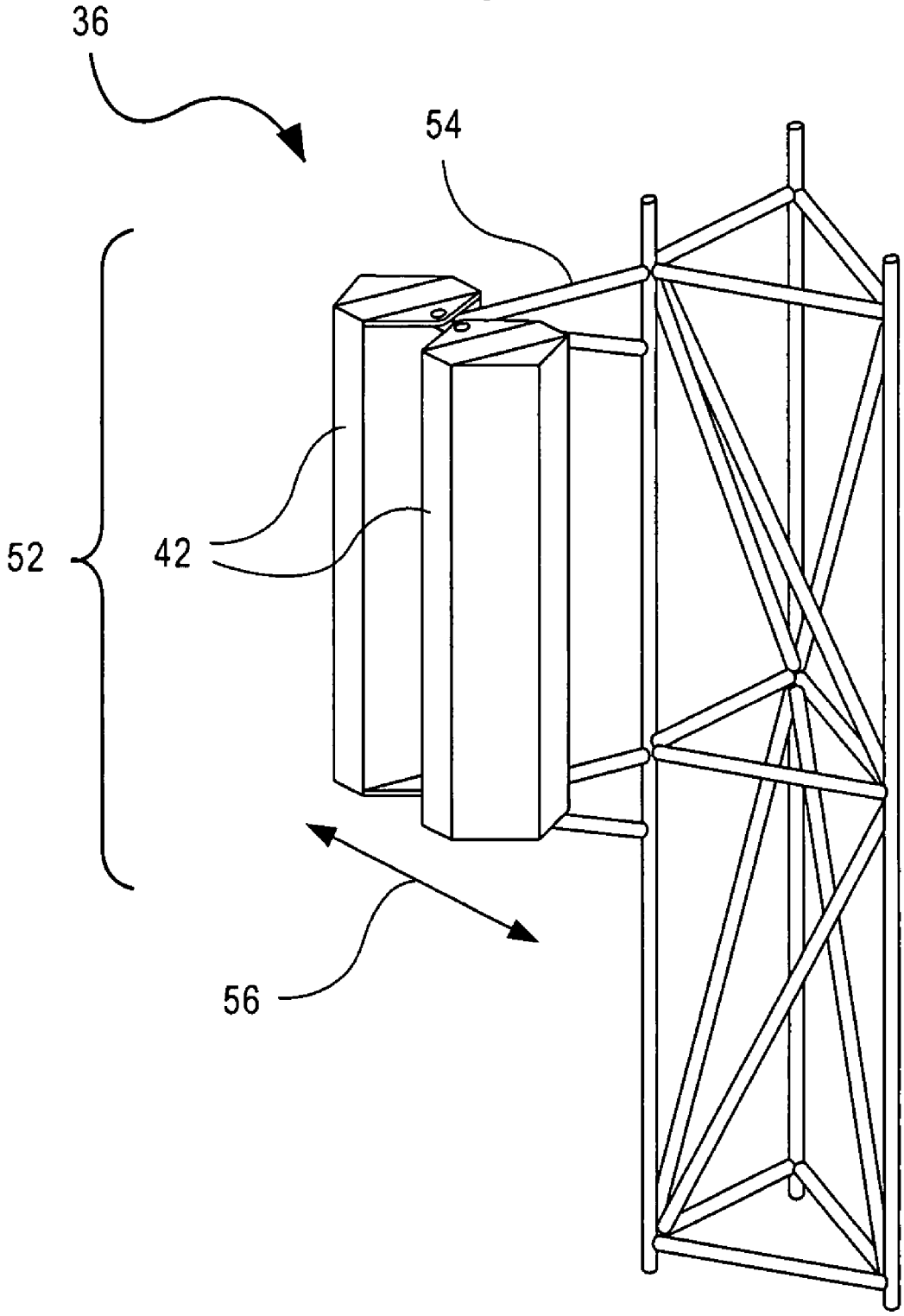
FIG. 3 (PRIOR ART)
FIG. 3 is a perspective view of a prior art panel antenna.

FIG. 3 illustrates a portion of a known panel antenna 36, wherein the antenna 36 has at least two radome-covered radiators 42 forming a single bay 52 as shown. The radiators 42 each radiate away from their common mounting 54 along the axis 56 shown, with propagation pattern and peak signal strength that depend on the details of radiator 42 design. A tower carrying multiple bays 52 stacked vertically can realize higher gain (less elevation spread) than a single bay 52 by using proper power splitting and phase synchronization.

FIG. 4 shows a representative signal strength chart 38 for known panel antennas; each of the two lobes 40 is emitted from one panel radiator 42 as shown in FIG. 3. FIG. 4 depicts the radiation pattern 38 with respect to azimuth of an antenna 36 with at least one bay using a back-to-back pair of panel antennas, such as those shown in FIG. 3. Between the lobes 40 are deep nulls 58, which require fill by some method to avoid loss of function, such as loss of signal for a mobile television as it passes near the antenna.

Figure 5:
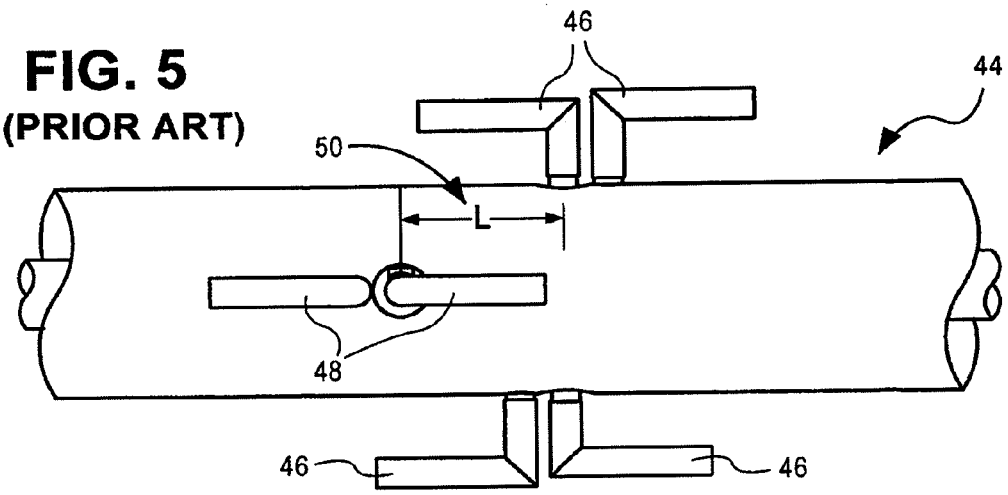
FIG. 5 (PRIOR ART)
FIG. 5 is a partial side view of a prior art antenna.

As shown in FIG. 5, the structure of antennas 44 according to the '644 application permits signal radiation with rotating phase and a high degree of azimuthal uniformity. The first two dipoles 46 in each bay are inverted with respect to each other, which causes them to radiate with opposite phase when excited from a common source, which would originate beyond the rightmost extent of FIG. 5. The second two dipoles 48 (the fourth dipole is located behind the coax) in each bay are located a distance 50 (L) that is a quarter-wavelength (90 degrees) further from the signal source than the first two dipoles 46. The second two dipoles 48 are likewise relatively inverted. As a result, the signal applied to the four dipoles 46, 48 radiates with successive 90 degree shifts around the coax 12, shown in FIG. 1. This phase rotation is repeated substantially synchronously (delayed approximately one cycle per bay by the traveling wave feed) at each bay 14. Provided that corresponding dipoles 46, 48 in all bays 14 are substantially aligned, the signals from all bays 14 reinforce to provide gain, and the output is substantially omnidirectional.

Figure 6:
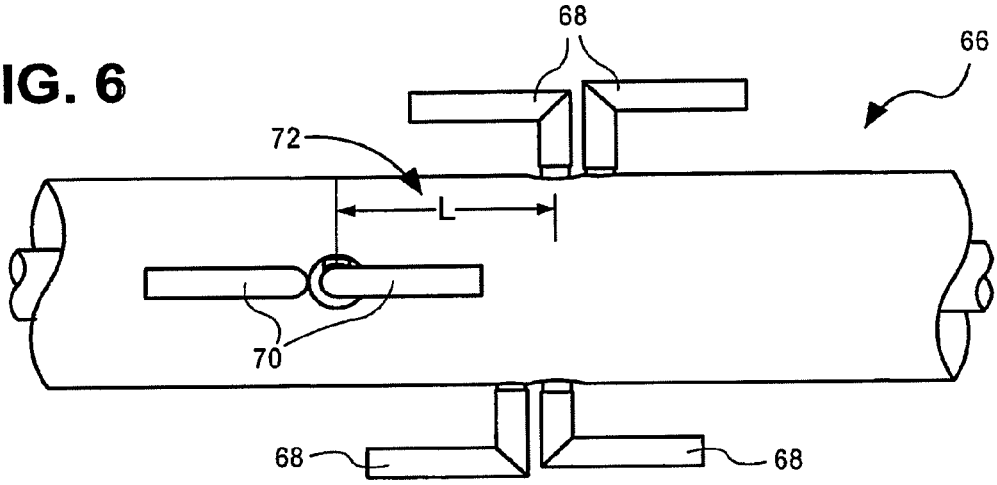
FIG. 6 is a partial side view of an antenna according to one embodiment of the invention.

FIG. 6, by contrast with FIG. 5, shows a partial side view of an antenna 66 according to an embodiment of the invention, wherein the spacing between the first dipole pair 68 and the second dipole pair 70 (the fourth dipole is located behind the coax) is changed from the quarter-wavelength distance L 50 (90 degrees) of an antenna 44 according to the '644 application, shown in FIG. 5, to a one-third wavelength distance L 72 (120 degrees) in an antenna 66 according to an embodiment of the invention. This change within the spacing of the first and second dipole pairs 46 and 48 versus 68 and 70, respectively, shifts the emission in time and alters phase progression, so that intermediate azimuth angles no longer manifest substantially full-power signals with intermediate phase angles. Instead, the signals from the dipoles closest in phase reinforce at some intermediate angles and cancel at others. As a result, the primary lobes 74 (shown in FIG. 8, further addressed below) are skewed somewhat, with peak signal strength driven in part by phase-proximal dipoles, while the secondary lobes 76 are minor artifacts associated with signal reinforcement and cancellation, and the nulls 78 are associated with strong cancellation between substantially out-of-phase radiators.

The respective distances L in FIGS. 5 and 6, identified by respective reference numerals 50 and 72, are prescribed to establish the relative phase of the two sets of dipoles in each bay. As this distance L is changed, the overall radiation pattern with azimuth changes. The value of L shown in FIG. 6, which is increased by about a third, to 120 degrees or a third of a wavelength, compared to such embodiments of the '644 application as the one shown in FIG. 5, is desirable at least for a class of transmitting antennas for highway mobile broadcast applications in the indicated frequency range. For other applications and frequency ranges, adjustment of the prescribed phase spacing L, such as to a value different from a third of a wavelength, can be used to balance spacing of transmitter towers, power per transmitter, expected mobile radio sensitivity, signal leakage and intrusion from beyond the intended zone, and other considerations. As with other multiple-bay antennas, the number of bays per antenna, the spacing between bays, and the amount of signal applied to each bay can be prescribed in consideration of tower height, main beam width, beam tilt, null fill, and other factors.

Analysis and test demonstrate that the dipoles 16, 18, 20, and 22, shown in FIG. 1 and making up each bay 14 in antennas 10 according to some embodiments of the invention, exhibit substantial impedance cancellation, so that the input impedance of the antenna 10 is substantially independent of the number of bays in the antenna. Power level to each bay 14, and to some extent to each dipole 16, 18, 20, and 22 within a bay 14, can be varied by selecting dielectric thickness to establish a preferred extent of coupling from the coaxial line to each dipole, with manageable effect on overall impedance.

It is to be understood that an extent of impedance cancellation can be made substantially complete by a combination of equal coupling of dipoles 16, 18, 20, and 22 in a given bay 14 and quarter-wavelength spacing L between the longitudinally displaced dipole couplings within a given bay 14, as described in the '644 application. Variations from this equal-coupling, quarter-wavelength-spacing configuration tend to narrow antenna bandwidth and to increase the extent to which transmission line loading by the radiative elements appears as successive lump impedances across the characteristic transmission line impedance of the coax 12. Each such variation may manifest as resistance plus capacitive or inductive reactance, in series and/or parallel, with the spacing and coupling variation correlated to an extent of phase alteration. The plurality of possible variations, along with differences in the rate of change of emission pattern and line loading with dimension variation, permit an antenna according to the '644 application to be adapted according to the invention disclosed herein to provide non-omnidirectional propagation over a broad range of patterns. Techniques used may include longitudinal and radial shifting of the locations of corresponding dipoles in each bay 14 and adjusting coupling, as disclosed herein.

Figure 7:
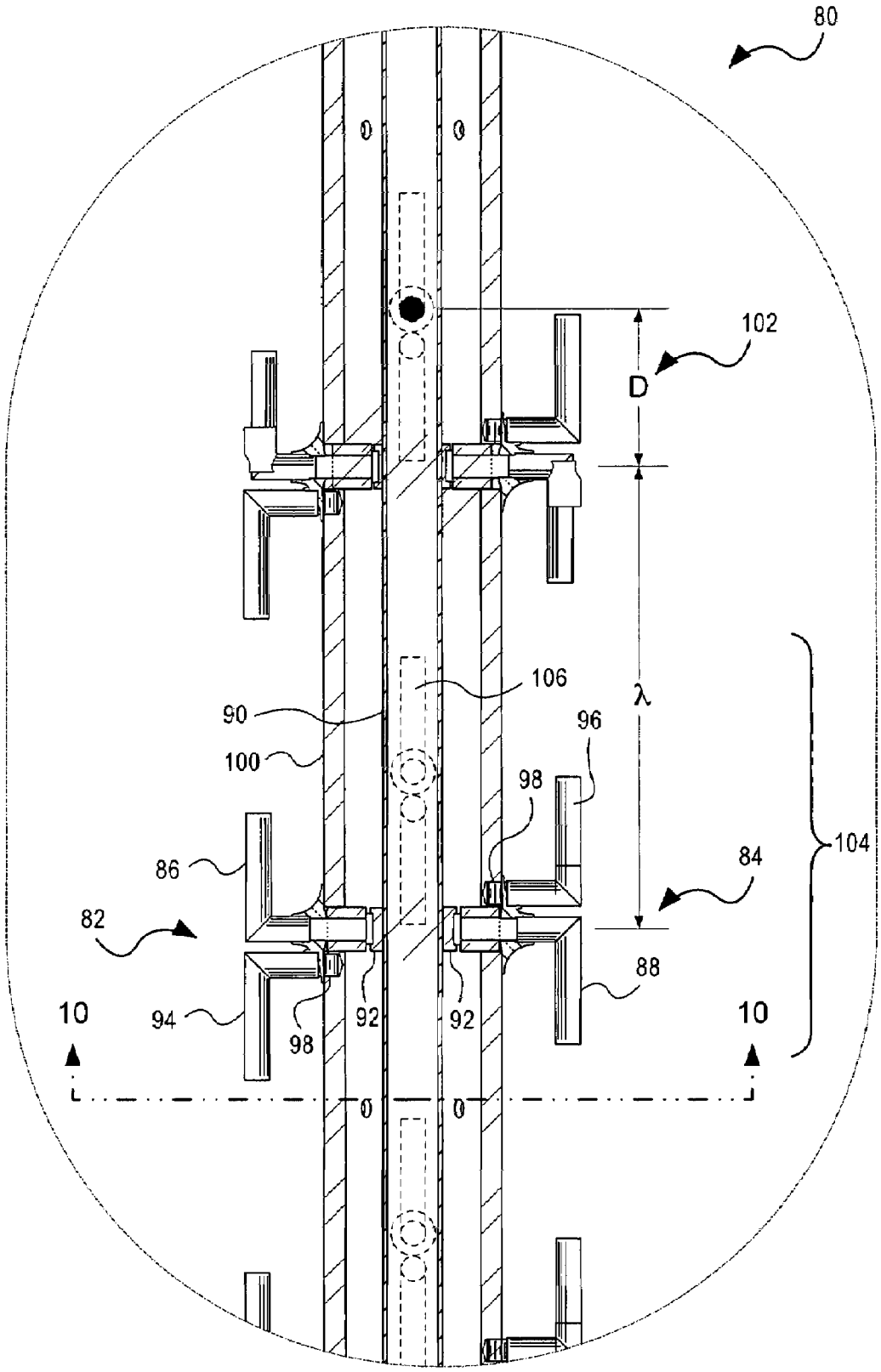
FIG. 7 is a partial section view of the antenna of FIG. 1.

FIG. 7 shows a section view of an antenna 80 according to the invention. The dipoles 82 and 84 are seen to have respective hot elements 86 and 88 fed from the inner conductor 90 using insulating pads 92 that function as the dielectric of capacitors formed between the hot elements 86 and 88 and the inner conductor 90. The respective cold elements 94 and 96 of the dipoles 82 and 84 are pressed into interference-fit holes 98 in the outer conductor 100, forming electrical joints, in the embodiment shown. It is implicit in referring to the elements as hot and cold that the feed line to the antenna and the traveling wave coax of the antenna itself may provide kilowatt-level RF excitation to their respective inner conductors while keeping their outer conductors at substantially ground potential, for safety, reliability, and such considerations as lightning protection of the transmitter. While not mandatory, this assumption drives at least the hot and cold reference terminology. Other physical arrangements are possible, and the arrangement indicated should not be viewed as limiting.

The component dimensions of the dielectric pads 92 may be substantially uniform in some embodiments. In those embodiments, if the coupling capacitances are roughly equal for all dipoles, the remaining signal level in the center coaxial conductor decreases by logarithmic steps with successive bays, and, as a consequence, successive dipoles tend to couple decreasing amounts of power from the center coax. While desirable in many embodiments, and well known in the art for traveling wave antennas, this can be changed by adjusting coupling in successive bays (thickness of the pads 92) according to a chosen sequence. For example, thickness can be decreased as a function of position (such as the logarithm) in successive bays to yield substantially uniform emission from each bay. Alternatively, in order to increase bay power at the center of the aperture, for example, pad 92 thickness can decrease faster than the above function calls for from bottom to middle of the antenna 10, with uniform pad 92 thickness applied from middle to top. Any comparable strategy, including uniform pad 92 dimensions and log taper of power per bay, may provide a desirable combination of producibility and performance in some embodiments.

Termination of the antenna can be realized with a terminal short-circuit spaced a quarter-wavelength from the bay distal to the feed port; in some embodiments this can cause the termination to reflect as an open. In keeping with this, the dipoles of the distal bay may have thinner pads 92 to increase capacitive coupling and minimize the signal remaining to reach the terminal short-circuit. Various other termination strategies are known in the art for traveling wave antennas; in many embodiments, it is possible to provide at least a substantially nonreactive termination, with a minimally dissipative termination preferred in order to maximize radiated power and minimize losses and reflections.

As noted above, the separation dimension 102 (D) in FIG. 7 is nominally one-third wavelength for the embodiment shown. The first two hot elements 86 and 88, respectively, in each bay 104 are spaced one-third wavelength away 102 from the second two elements, of which one, 106, is shown dashed, and the other is not visible in this section view. Ninety degrees of phase shift for the latter elements can provide phase rotation and impedance cancellation. Complete impedance cancellation would prevent the multiple parallel loads of the bays from lowering antenna input impedance, so that no compensating input transformer would be needed. An input transformer may be appropriate in antennas according to the invention, but such a transformer may require a lesser transformation ratio than transformers in designs lacking impedance cancellation, and the phenomenon of narrowing the working bandwidth of the antenna due to the need for a high number of impedance steps—the coaxial-line equivalent of a coil-based transformer's turns ratio—may be diminished.

As employed in the invention disclosed herein, the one-third wavelength separation dimension 102 (D), i.e., 120 degrees rather than 90 degrees, affects impedance cancellation somewhat and strongly affects lobe balance and lobe skew. Because impedance cancellation changes only slowly with separation 102, while lobe balance and lobe skew vary relatively rapidly, varying separation 102 to affect lobe balance and lobe skew is a useful mechanism for producing antennas that vary widely in lobe shape, orientation, balance, and skew. As a corollary, it may be seen that the dimension 102 (D) is relatively critical in establishing a particular lobe shape, orientation, balance, and skew in at least some embodiments, although it can be obviated or combined with alternative methods of realization in other embodiments. This is shown further in the figures discussed below.

FIG. 8 depicts the radiation pattern 108 with respect to azimuth of an antenna according to an embodiment of the invention. Primary lobes 74 are substantially oriented as corresponding lobes in known antennas, while secondary lobes 76, skewed to lie in the vicinity of 110 degrees and 290 degrees, may be seen from the chart of FIG. 8 to be attenuated by about 6 dB (peak voltage value is about 50%; 20 log (0.5)=−6) and to show no appreciable nulls between the skewed secondary lobes 76 and the proximal primary lobes 74. Calculated signal strength in the nulls 78, located at approximately 160 degrees and 340 degrees, is about −8 dB (20 log(0.4)=−8) referred to the primary lobe 74 peaks, significantly higher than the vanishingly-small signal (below −10 dB over two 30-degree arcs) in the nulls 58 of the panel antenna configuration of FIG. 4.

Figure 9:
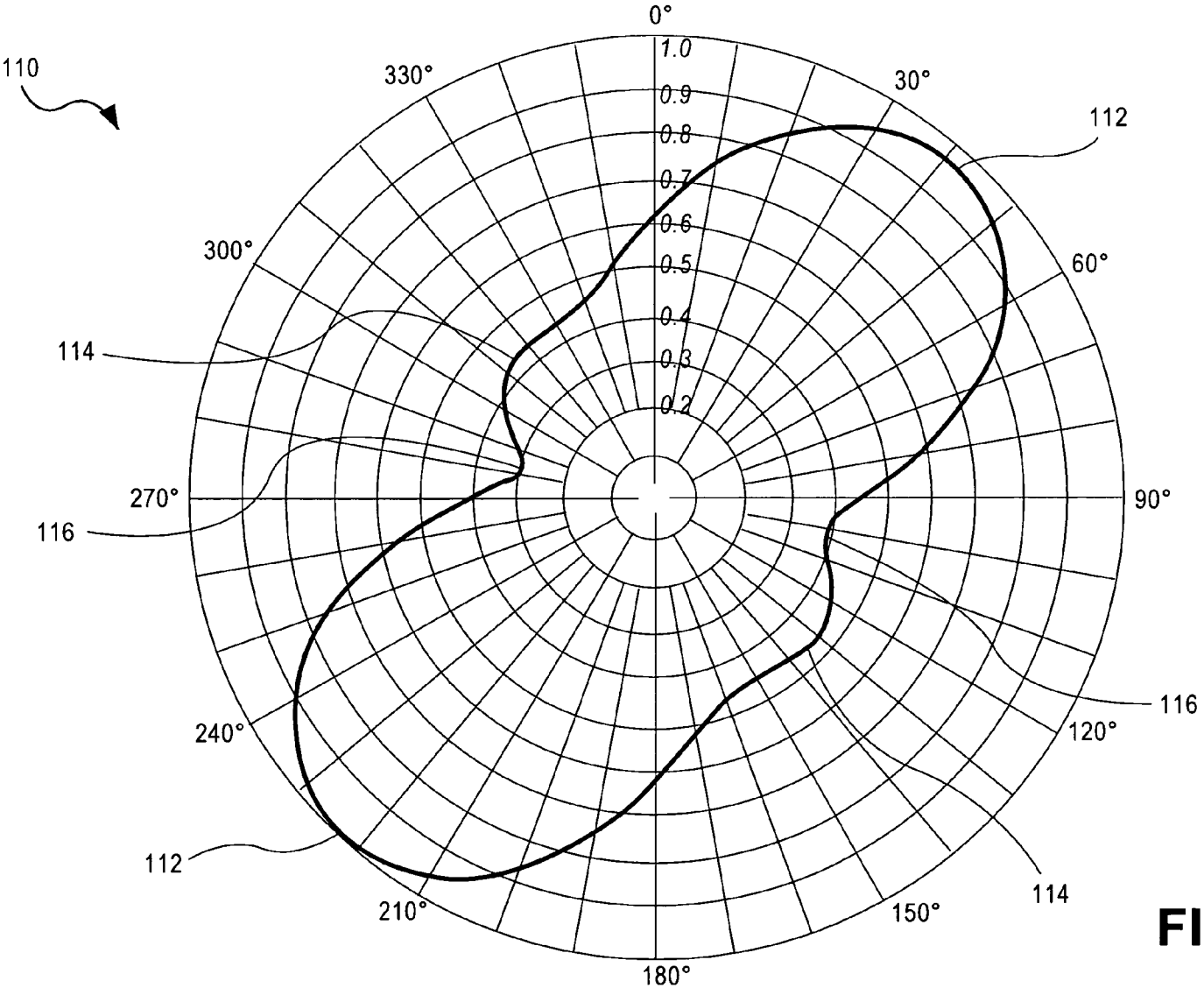
FIG. 9 is a measured chart plotting signal strength versus azimuth according to one embodiment of the invention.

FIG. 9 is a measured radiation pattern 110 of an antenna according to an embodiment of the invention. It may be readily observed that primary lobes 112, secondary lobes 114, and nulls 116 correspond closely to those of the analytical model of FIG. 8, other than orientation. The −7 dB (average) skewed secondary lobes 114 fall at approximately 130 degrees and 310 degrees, and the −8.4 dB and −10.5 dB nulls 116 are at approximately 105 degrees and 280 degrees, respectively. The invention may accept further alteration, such as for further narrowing or widening the primary lobes 112, reducing null 116 depth in exchange for increasing secondary lobe 114 magnitude or skew, and the like.

Substantial beam tilt can be established by adjusting the spacing between bays, with a bottom-feed antenna requiring decrease in spacing to depress the main beam below the horizon, and with the opposite case remaining valid—that is, the beam of a bottom-fed antenna can be directed upward by increasing interbay spacing, while a top-fed antenna requires increased interbay spacing for downward direction of the beam, and decreased interbay spacing to direct the beam upward. Null fill can be realized by providing interbay spacing that changes from bay to bay, with the variation determining the extent of null fill over a significant range.

It is to be understood that the software model and prototype test results of FIG. 9 refer to an embodiment wherein the second dipole pair has been shifted about a sixth of a wavelength from the omnidirectional configuration of the '644 application. Any shift greater or less than this amount over a significant range will likewise produce a potentially acceptable, albeit likely different, combination of impedance cancellation and alteration of lobe shape, orientation, balance, and skew. Dipole shifts in the negative direction—that is, shifting the second pair closer to the first pair than one-quarter wavelength rather than further away as in the embodiment shown—will likewise produce an effect comparable to that described, but with lobe alteration differing in detail, and with the characteristics of impedance cancellation differing as well.

FIG. 10 is a cross-sectional view applying equally to antennas 44 and 66 of FIGS. 5 and 6, respectively. By contrast, FIG. 11 is a cross-sectional view of the antenna 120 shown in part in FIG. 12, wherein dipole physical azimuth angle is used in place of traveling wave phase angle to achieve a broadly equivalent non-omnidirectional propagation pattern. The arrangement of FIG. 12 may introduce significant tradeoffs when used with certain fabrication apparatus. It can be beneficial, in view of the general desirability of increasing automation and decreasing setup, for holes and insert fittings to be parallel to or at right angles to each other, as in the elements 122 of FIG. 10. Thus, an antenna built as in FIGS. 11 and 12, with respective dipoles 124 not at right angles, may be more costly to position, drill, and assemble, although such an arrangement may be advantageous for some embodiments.

Figure 12:
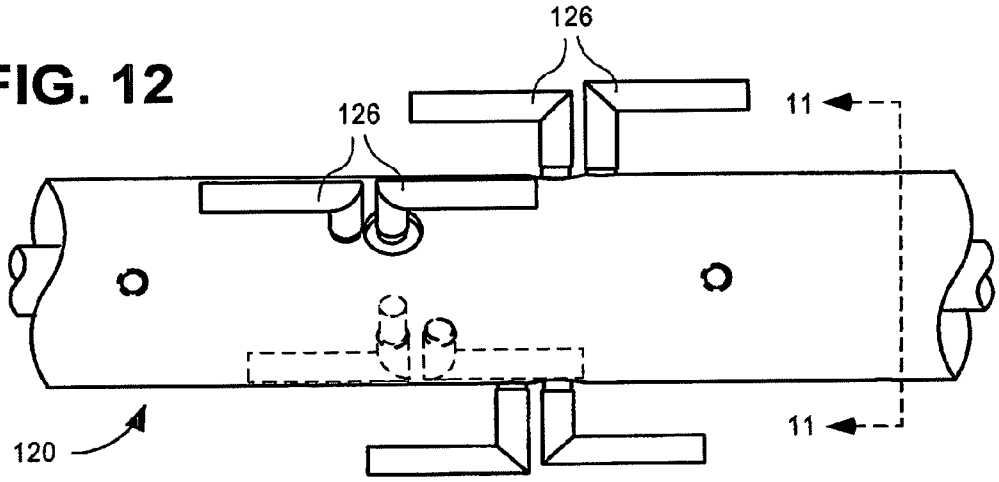
FIG. 12 is a partial side view of an antenna according to one embodiment of the invention.

Similarly, rotation of physical azimuth angle, as in FIGS. 11 and 12, and traveling wave phase angle, as in FIG. 6, may be combined in some embodiments. For example, pronounced beam narrowing may be combined with reduced degradation of impedance cancellation by incorporating both processes to a greater or lesser extent, with the final configuration determined by analysis of computer modeling and prototype testing.

FIG. 13 illustrates an antenna wherein the overall structure 126 is asymmetrical—that is, while the dipoles 124 in the section in FIG. 11 lie in two planes, embodiments such as the antenna 26 of FIG. 13 place the dipoles 128 in four half-planes without excessively degrading impedance cancellation. Signal propagation for such embodiments may be asymmetrical, which can provide capabilities that symmetrical arrangements cannot achieve.

Likewise, longitudinal placement of dipoles with respect to the antenna feed port may be nonsymmetrical in some embodiments. As long as the four dipoles at each bay approximate the equal loading achieved with separation by one-quarter wavelength, impedance cancellation is preserved to at least some extent. Thus, each two dipoles may be above and below a nominal tap point, with a predictably asymmetrical propagation pattern, but without unacceptable degradation of loading.

Although elements in successive bays are suggested by the figures to have uniform spacing in successive bays, so that the beams produced have gain over azimuth that is a function of the number of bays, it is also possible to adjust the element arrangement and thus the beam shape of each bay independently of the other bays, so that the overall antenna nulls and secondary lobes are tailored to a desired profile. Such variations will generally widen the beam and reduce the effective gain by increasing signal cancellation, but may be used in lieu of omnidirectional radiators at freeway interchanges, for example. Development of individual antennas with tailored beam shape will in typical embodiments require recourse to antenna design software prior to fabrication of hardware, and validation by test afterward. Since this potentially adds to development, fabrication apparatus programming, touch labor, and testing costs, it is foreseeable that standard designs such as those of FIGS. 6 and 12 may be preferred for many applications.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and, accordingly, all suitable modifications and equivalents may be resorted to that fall within the scope of the invention.

What is claimed is:

1. An antenna system for electromagnetic signals, operational over a frequency range, comprising:

a substantially vertical and linear coaxial transmission line having an outer conductor and an inner conductor with a common longitudinal axis, wherein the transmission line is configured to carry electromagnetic signals over a frequency range, and wherein the transmission line originates at an origination node and ends at a terminal node; and a first bay configured to radiate at least a portion of the electromagnetic signals carried on the transmission line, further comprising a plurality of vertically oriented dipoles, wherein the dipoles that comprise the first bay occupy a first longitudinal position along the transmission line, proximal to the origination node, wherein the first bay dipoles include elements coupled to the inner conductor at a plurality of azimuthal and longitudinal positions, wherein the respective positions of the first bay dipole elements jointly provide impedance cancellation at least in part, and wherein the combination of azimuthal position and relative longitudinal position of the first bay dipole elements realizes a substantially non-omnidirectional pattern of signal strength and gain.

2. The antenna system of claim 1, wherein the first bay further comprises:

two first dipoles comprising:

first elements, coupled to the inner conductor at radially opposed loci at a common longitudinal position with respect to the origination node, wherein respective first elements have transmission portions directed radially outward through the outer conductor for a first prescribed length, wherein respective first elements further have radiating portions directed opposite to each other and parallel to the coaxial line longitudinal axis for a second prescribed length, and wherein centroids of the respective portions of the first elements lie substantially within a plane that includes the coaxial line longitudinal axis; and second elements, substantially coplanar with the first elements, coupled to the outer conductor, wherein each second element has a transmission portion directed radially outward from the outer conductor and parallel to the transmission portion of the first element proximal thereto, wherein each second element further has a radiating portion substantially collinear with, directed oppositely to, and equal in length with the radiating portion of the proximal first element, wherein the first and second elements form dipoles of substantially opposite phase on opposite sides of the coaxial line; and two second dipoles substantially identical to the first dipoles, wherein a plane of the second dipoles is substantially perpendicular to the plane of the first dipoles, wherein a prescribed distance from coupling loci of the first dipoles to coupling loci of the second dipoles within the first bay differs from one quarter wavelength of an antenna midband frequency to an extent sufficient to establish a first signal lobe and a second signal lobe whereof the respective azimuth maxima are substantially equal in magnitude, opposite in azimuth with respect to the transmission line longitudinal axis, and collinear, and wherein the prescribed coupling distance reduces magnitude of a third signal lobe and a fourth signal lobe relative to the first and second signal lobes to a prescribed extent.

3. The antenna system of claim 1, wherein the antenna further comprises a second bay, configured to radiate at least a portion of the electromagnetic signals carried on the transmission line, further comprising a plurality of vertically oriented dipoles, wherein dipoles that comprise the second bay are located proximal to a second longitudinal position along the transmission line, distal to the origination node with respect to the first bay, wherein the second bay dipoles include elements coupled to the inner conductor at a plurality of azimuthal and relative longitudinal positions, wherein the respective positions of the second bay dipole elements jointly provide impedance cancellation at least in part, and wherein the dipoles that form the second bay are longitudinally separated from and rotationally aligned with respective dipoles of the first bay to an extent that allows signal emission from the respective bays to establish a reinforcing pattern of signal strength and gain.

4. The antenna system of claim 3, wherein the second bay further comprises two first dipoles and two second dipoles, wherein each dipole of the second bay is substantially identical in form to a corresponding dipole in the first bay, wherein the dipoles of the second bay are positioned along the coaxial line longitudinal axis with respect to each other as are respective dipoles in the first bay, and wherein each dipole of the second bay has a radiating portion substantially coaxial with the radiating portion of a corresponding dipole in the first bay.

5. The antenna system of claim 3, wherein longitudinal spacing between bays differs from an integer number of wavelengths of the antenna midband frequency to an extent sufficient to establish a prescribed beam tilt.

6. The antenna system of claim 3, further comprising at least one additional bay, wherein dipoles comprising the at least one additional bay are substantially identical in form and in distance along the coaxial line longitudinal axis with respect to the other dipoles in the at least one additional bay, and have radiating portions substantially coaxial with the radiating portions of corresponding dipoles in the first bay.

7. The antenna system of claim 1, wherein the first bay further comprises:

two first dipoles comprising:

first elements, coupled to the inner conductor at radially opposed loci at a common longitudinal position with respect to the origination node, wherein respective first elements have transmission portions directed radially outward through the outer conductor for a first prescribed length, wherein respective first elements further have radiating portions directed opposite to each other and parallel to the coaxial line longitudinal axis for a second prescribed length, and wherein centroids of the respective portions of the first elements lie substantially within a plane that includes the coaxial line longitudinal axis; and second elements, substantially coplanar with the first elements, coupled to the outer conductor, wherein each second element has a transmission portion directed radially outward from the outer conductor and parallel to the transmission portion of the first element proximal thereto, wherein each second element further has a radiating portion substantially collinear with, directed oppositely to, and equal in length with the radiating portion of the proximal first element, wherein the first and second elements form dipoles of substantially opposite phase on opposite sides of the coaxial line; and two second dipoles substantially identical to the first dipoles, wherein a prescribed distance from the coupling loci of the first dipoles to coupling loci of the second dipoles within the first bay is substantially one quarter wavelength of an antenna midband frequency, wherein a plane of the second dipoles is rotated to a non-perpendicular angle with respect to the plane of the first dipoles to an extent sufficient to establish a first signal lobe and a second signal lobe whereof respective azimuth maxima are substantially equal in magnitude, opposite in azimuth with respect to the transmission line longitudinal axis, and collinear, and wherein the prescribed non-perpendicular angle reduces magnitude of a third signal lobe and a fourth signal lobe relative to the first and second signal lobes to a prescribed extent.

8. The antenna system of claim 1, wherein the first bay further comprises:

two first dipoles comprising:

first elements, each coplanar with the coaxial line longitudinal axis, each coupled to the inner conductor, each having a transmission portion directed radially outward through the outer conductor for a first prescribed length, and each further having a radiating portion directed opposite to the other first element and parallel to the coaxial line longitudinal axis for a second prescribed length, wherein the transmission portions of the first elements are one of collinear, parallel, intersecting in a point at the longitudinal axis, and skew; and second elements, each coplanar with a respective first element, each coupled to the outer conductor, wherein each second element has a transmission portion directed radially outward from the outer conductor and parallel to the transmission portion of the first element proximal thereto, and wherein each second element further has a radiating portion substantially collinear with, directed oppositely to, and equal in length with the radiating portion of the proximal first element, whereby the first and second elements form dipoles of generally opposite phase on approximately opposite sides of the coaxial line; and two second dipoles substantially identical to the first dipoles, wherein a prescribed distance from coupling loci of respective transmission portions of the first dipoles to respective coupling loci of respective transmission portions of the second dipoles within the first bay so approximates one quarter wavelength of an antenna midband frequency as to provide substantial impedance canceling, wherein respective first elements of the second dipoles have respective transmission portions directed radially outward through the outer conductor for a first prescribed length, each of the respective first elements further having a radiating portion directed opposite to a radiating portion of the other and parallel to the coaxial line longitudinal axis for a second prescribed length, wherein respective transmission portions of the second dipole first elements are one of collinear, parallel, intersecting in a point at the longitudinal axis, and skew, and wherein the orientations of half-planes bounded by the coaxial line longitudinal axis and containing the respective second dipoles are rotated to such angles as to establish phase rotation of emitted signals and to establish at least one signal lobe having maximum strength at an azimuth.

9. The antenna system of claim 1, wherein the coaxial line provides traveling wave feed to the respective elements.

10. The antenna system of claim 1, further comprising a plurality of bays distributed along the coaxial line from the origination node to the terminal node, wherein a last bay is that bay most distal to the origination node, and wherein the terminal node further comprises a short circuit between the outer and inner conductors of the coaxial line, positioned beyond coupled dipole elements of the last bay by a length prescribed to cause the short circuit to appear to the last bay as a substantially nonreactive load.

* * * * *